US010150653B2

(12) United States Patent
Kyllingstad

(10) Patent No.: US 10,150,653 B2
(45) Date of Patent: Dec. 11, 2018

(54) METHOD FOR REDUCING DYNAMIC LOADS OF CRANES

(71) Applicant: National Oilwell Varco Norway AS, Stavanger (NO)

(72) Inventor: Age Kyllingstad, Algard (NO)

(73) Assignee: NATIONAL OILWELL VARCO NORWAY AS, Stavanger (NO)

( * ) Notice: Subject to any disclaimer, the term of this patent is extended or adjusted under 35 U.S.C. 154(b) by 341 days.

(21) Appl. No.: 15/069,254

(22) Filed: Mar. 14, 2016

(65) Prior Publication Data

US 2016/0194183 A1 Jul. 7, 2016

Related U.S. Application Data

(63) Continuation of application No. 13/636,964, filed as application No. PCT/NO2011/000087 on Mar. 17, 2011, now abandoned.

(30) Foreign Application Priority Data

Mar. 24, 2010 (NO) ..... 20100435

(51) Int. Cl.

| | |
|---|---|
| ***B66C 13/06*** | (2006.01) |
| ***B66C 13/04*** | (2006.01) |
| ***B66C 23/06*** | (2006.01) |
| ***B66C 23/10*** | (2006.01) |
| ***B66C 23/12*** | (2006.01) |
| ***B66D 1/52*** | (2006.01) |

(52) U.S. Cl.

CPC ..... *B66C 13/06* (2013.01); *B66C 13/04* (2013.01); *B66C 13/066* (2013.01); *B66D 1/52* (2013.01); *B66D 1/525* (2013.01); *B66C 23/06* (2013.01); *B66C 23/10* (2013.01); *B66C 23/12* (2013.01)

(58) Field of Classification Search

CPC ..... B66C 13/04; B66C 13/06; B66C 13/066; B66C 23/06; B66C 23/10; B66C 23/12; B66D 1/52; B66D 1/525

See application file for complete search history.

(56) References Cited

U.S. PATENT DOCUMENTS 6,505,574 B1 * 1/2003 Naud ..... B66D 1/525 114/268

2007/0272906 A1 * 11/2007 Davidson ..... B66D 1/525 254/270

* cited by examiner

*Primary Examiner* — Dale W Hilgendorf

(74) *Attorney, Agent, or Firm* — Conley Rose, P.C.

(57) ABSTRACT

A method and related device for reducing resonant vibrations and dynamic loads of cranes, where vertical motion of a pay load is controlled by a boom winch and a hoist winch. In an embodiment, the method includes determining resonance frequencies of the crane boom and pay load from inertia data of the boom and stiffness on at least the boom and hoist ropes, the resonance frequencies including a first frequency and a lower second frequency. In addition, the method includes automatically modifying the motion of the boom winch or the hoist winch to induce a damping inducing winch motion in the boom or hoist winch, by tuning a proportional integral (PI)-type boom winch speed controller or a PI-type hoist winch speed controller. The boom winch speed controller is tuned to absorb energy at the second frequency, the hoist winch speed controller is tuned to absorb energy at the first frequency.

9 Claims, 4 Drawing Sheets

METHOD FOR REDUCING DYNAMIC LOADS OF CRANES

CROSS-REFERENCE TO RELATED APPLICATIONS

This application is a continuation of U.S. patent application Ser. No. 13/636,964, filed Oct. 29, 2012, and entitled "Methods For Reducing Dynamic Loads of Cranes,": which is 35 U.S.C. § 371 national stage application of PCT/NO2011/000087 filed Mar. 17, 2011, which further claims the benefit of Norwegian Application No. 20100435 filed Mar. 24, 2010, each of which are incorporated herein by reference in their entireties for all purposes.

STATEMENT REGARDING FEDERALLY SPONSORED RESEARCH OF DEVELOPMENT

Not applicable.

BACKGROUND

Field of Invention

The invention relates generally to a method for reducing dynamic loads of cranes. More precisely, the invention relates to a method for reducing resonant vibrations and dynamic loads of cranes, whose horizontal and vertical motion of the pay load is controlled by a boom winch controlling the lulling motion of a pivoting boom and a hoist winch controlling the vertical distance between the boom tip and the pay load.

Background of the Technology

Offshore cranes are frequently used for sea lifts where the load is picked up from a floating supply vessel. Such lifts normally represents higher dynamic loads to the crane than a similar rig or platform lift where the load is lifted from the same structure as the crane base.

The potential high dynamic load related to sea lift is closely linked to the difference in vertical speed between the vessel and the crane. If the load is lifted off the vessel deck while the vessel is moving downwards, then the jerk can make the peak load of the crane exceeding the allowable maximum. The risk of dynamic overloading and damages therefore increase with increasing load and vessel motions.

A skilled crane operator can often reduce the peak loads by picking the load off the vessel at the optimal heave phase, that is, when the vertical speed difference between vessel and boom tip is low. However, because the vessel heave is a stochastic process leading to non-periodic and unpredictable heave motion and because the humans can make mistakes, there is still a risk that the crane can be overloaded.

The load chart, which defines maximum allowable crane loads at different boom radii and rig heave conditions, is chosen to lower this risk to acceptable levels. The limitations in the operational weather window means high costs as a result of more waiting on weather.

The purpose of the invention is to overcome or reduce at least one of the disadvantages of the prior art.

BRIEF SUMMARY OF THE DISCLOSURE

The purpose is achieved according to the invention by the features as disclosed in the description below and in the following patent claims.

There is provided a method for reducing resonant vibrations and dynamic loads of cranes, whose horizontal and vertical motion of the pay load is controlled by a boom winch controlling the luffing motion of a pivoting boom and a hoist winch controlling the vertical distance between the boom tip and the load, wherein the method includes the steps of:

- determining the resonance frequencies of the coupled crane boom and load system, either experimentally or theoretically from data on stiffness and inertia of the boom and stiffness of at least a boom rope, a hoist rope, a pedestal and an A-frame;
- automatic generation of a damping motion in at least one of said winches, that counteract dynamic oscillations in the crane; and
- adding this damping motion to the motion determined by a crane operator.

The damping inducing winch motion may be obtained through feedback of high-pass or band-pass filtered values of measured tension forces in the luffing rope and in the hoist rope.

The damping inducing winch motion may be obtained through tuning of standard PI-type winch speed controllers, where the top winch speed controller is tuned to absorb vibration energy most efficiently around the lowest crane resonance frequency and where the hoist winch speed controller is tuned to absorb vibration energy most efficiently around the highest crane resonance frequency.

Integral factors of the boom winch speed controller are chosen to be substantially equal to the product of effective inertia and the squared angular boom resonance frequency and the integral factor of the hoist winch speed controller is chosen to be substantially equal to the product of effective inertia and the squared angular boom resonance frequency and the proportional factors of the speed controllers are chosen to be linear combinations of the inverse resonance frequencies squared to give a desired decay rate for the two resonance modes.

The proportional factor of the boom winch speed controller may be chosen to be proportional to the square of the effective stiffness of the crane pedestal and the boom rope and inversely proportional to the boom inertia and the square of angular boom resonance frequency squared, and the proportional factor of the hoist winch speed controller is chosen to be proportional to the square of the effective stiffness of the hoist rope and inversely proportional to the load inertia and the square of angular load resonance frequency, to give a desired decay rate for the two resonance modes.

The absorption band width may be increased and the effective inertia of at least one winch is reduced by adding a new inertia compensating term in the speed controller, the new term being the product of the time derivative of the measured speed and a fraction of the mechanical winch inertia. Below, some basic crane dynamics is explained under reference to items and distances shown in an enclosed FIG. 1. FIG. 1 shows a simplified and schematic view of a typical offshore crane. Examples relating to the basic crane dynamics are included in the specific part of the description, where also the theory related to a couple of embodiments are included.

The change in boom angle, often called the luffing motion, is controlled by a winch, hereafter called the boom winch. The boom winch is normally placed on a slewing platform and controls by the help of a boom rope, the distance between an A-frame top and the connecting point of a boom. This boom rope, which is also called the boom guy rope, normally has a plurality of falls, typically 4-8.

A hoist winch directly controls the vertical position of a hook via the hoist rope. The hoist winch is normally placed on the boom near a hinge which connects the boom to the slewing platform. The latter may be turned about a vertical or nearly vertical axis, by slewing motors. The slewing platform is connected to the crane pedestal, which is the base of the crane and is a part of the rig or platform structure for offshore cranes.

In contrast to the simplified example here most offshore cranes have two sets of hooks and hoist winches. The main hoist is designed for heavy lifts and has a plurality of falls. In contrast, the whip hoist has normally one fall, giving less pull capacity but higher hoist speed capacity. The whip hoist normally has a higher load radius than the main hoist because its tip sheave is located near the tip of the boom extension called the whip. Although the analysis and examples below focus on the main hoist, the methods apply equally well for whip hoists.

The crane is not a completely rigid structure where the boom and load motion is determined by their winches only. On the contrary, the elasticity of the crane elements, especially the hoist and boom ropes make the crane a dynamic structure with several dynamic natural oscillation modes. The natural frequencies of these modes will change as function of the boom angle and the pay load, as explained briefly in the following.

The method according to the invention thus involves a modified speed control so that the winch speed responds to variations in the load.

For convenience and for limiting the mathematical complexity, the dynamics of the crane will be studied under the following simplifying assumptions:

There is no slewing motion of the crane;

Pendulum motion of the load is neglected;

Translatory motion of the boom hinge is neglected;

The boom is completely stiff;

The inertia of pedestal and A-frame is neglected;

The dynamic motions are relatively small;

The rope tension is always positive; and

The load is not in contact with the vessel.

The three first assumptions imply that the crane is treated as a two degree-of-freedom system: angular boom motion (pivoting around the stationary hinge) and vertical motion of the load. The two last assumptions imply that the problem can be linearized around a working condition with constant stiffness and inertia. Each of these limitations may be taken into account in the calculation, but experience shows that the method according to the invention function sufficiently well even with such limitations.

With these assumptions the equation of angular motion of the boom is:

$$J_b\ddot{\beta}=f_aR_a-f_hR_l-M_bgR_b \tag{1}$$

where $J_b$ is the boom inertia moment (referred to the hinge position), $\ddot{\beta}$ is the angular boom acceleration, $\beta$ is the boom angle (defined by the hinge to boom tip), $R_l$ is the load radius (horizontal distance from hinge to load), $R_a$ is the moment radius of top rope (distance to the hinge), $F_a$ is the tension force of the top ropes (acting on the A-frame sheaves), $F_h$ is the tension force of the hoist ropes (acting on the boom tip sheaves), $M_b$ is the boom mass, g is the acceleration of gravity, and $R_b$ is boom weight radius (horizontal distance from hinge to centre of gravity).

The radii $R_l$, $R_a$ and $R_b$ are slowly varying functions of the boom angle $\beta$ and can therefore be treated as constants in this analysis. The former is simply $R_l=L_b \cos \beta$ where $L_b$ is the boom length, that is the distance from the hinge to the tip sheaves. Explicit expressions for the two other radii are known to a skilled person and omitted here.

It is convenient to transform the equation of angular motion to an equivalent equation of vertical motion of the boom tip. This may be done by dividing the above equation by the load radius and introducing the following variables:

| | |
|---|---|
| $M_t=J_b/R_l^2$ | boom tip inertia mass |
| $v_t=R_l\dot{\beta}$ | vertical boom tip speed (positive upwards) |
| $f_t=f_aR_a/R_l$ | vertical boom tip force |
| $W_t=M_bg\ R_b/R_l$ | boom tip weight (gravitation force) |

The equation of motion for the boom can therefore be written as:

$$M_t\dot{v}_t=f_t-f_h-W_t \tag{2}$$

The corresponding equation of vertical motion for the load is simply:

$$M_l\dot{v}_l=f_h-W_l \tag{3}$$

where:

$M_l$ is the load mass, $v_l$ is the vertical load speed (positive upwards), $W_l=M_lg$ is the load weight.

The hoist rope force is a function of the elastic stretch of the hoist ropes. It may be expressed as:

$$f_h=S_h\int(v_t+w_l-v_l)dt \tag{4}$$

where $S_h$ is the effective stiffness of the hoist ropes and $w_l$ is the winch based part of the load speed. The stiffness can be explicitly written as:

$$S_h=\frac{n_hEA}{L_{hw}} \tag{5}$$

where $n_h$ is the number of hoist rope falls, $L_{hwb}$ is the total length the hoist rope spooled off the winch (exposed to tension), E is the effective modulus of elasticity for the rope, and A is the nominal cross section of the rope Similarly, the effective vertical boom tip force can be expressed by:

$$f_t=S_t\int(w_t-v_t)dt \tag{6}$$

where $S_t$ is the effective boom tip stiffness of the hoist ropes and iv, is the winch based part of the top speed. The stiffness is a function, not only of the top rope stretch but also of the elastic deflection of the pedestal and the A-frame. It may be expressed by:

$$S_t=\left(\frac{L_{tw}}{n_tEA}\cdot\frac{R_l^2}{R_a^2}+\frac{R_l^2}{S_p}\right)^{-1} \tag{7}$$

where $n_t$ is the number of top rope falls, $L_{wa}$ is the length of rope from the top winch to top of A-frame, $S_p$ angular stiffness of pedestal and A-frame.

For simplicity, it is assumed that the top and hoist ropes have the same diameter.

It is convenient to Fourier transform the equations of motions and forces. Denoting the angular frequency by ω, time differentiation and integration then reduce to respective multiplication and division by iω, $i=\sqrt{-1}$ being the imaginary unit. It is also convenient to introduce the force vector defined by:

$$f \equiv \begin{bmatrix} f_t \\ f_h \end{bmatrix} = \begin{bmatrix} S_t & 0 \\ 0 & S_h \end{bmatrix} \cdot \begin{bmatrix} w_t \\ w_l \end{bmatrix} \frac{1}{i\omega} - \begin{bmatrix} S_t & 0 \\ -S_h & S_h \end{bmatrix} \cdot \begin{bmatrix} v_t \\ v_l \end{bmatrix} \frac{1}{i\omega} \equiv \frac{1}{i\omega}(Sw - S_v v) \tag{8}$$

and the force coupling matrix $$\Phi = \begin{bmatrix} 1 & -1 \\ 0 & 1 \end{bmatrix} \tag{9}$$

Throughout lower case bold symbols are used for amplitude vectors and upper case bold symbols for matrices. The constant gravitation force terms vanish in the Fourier transformation, and the equations of motion can be written as:

$$(-\omega^2 M + \Phi S_v)v = \Phi S w \tag{10}$$

The speed vectors v and w represents the complex amplitudes of the crane and load motions and winch motions, respectively. Various special cases of this matrix equation will be discussed below.

First, the simplest case when the winches are locked is considered. Then w=0 and the equation above reduces to the classical eigenvalue problem $$M^{-1}\Phi S_v v = \omega^2 I v \tag{11}$$

where I is the identity matrix. It can be shown that the system matrix can be written as:

$$A \equiv M^{-1}\Phi S_v = \begin{bmatrix} \omega_t^2 + \omega_c^2 & -\omega_c^2 \\ -\omega_l^2 & \omega_l^2 \end{bmatrix} \tag{12}$$

where $\omega_t = \sqrt{S_t/M_t}$ is the empty boom resonance frequency, $\omega_l = \sqrt{S_h/M_l}$ is the load resonance with a fixed boom tip, and $\omega_c = \sqrt{S_h/M_t}$ is a coupling frequency.

It is easily verified, by requiring that the determinant $|A-\omega^2 I|=0$, that the eigenvalues of A are:

$$\omega^2 = \tfrac{1}{2}(\omega_t^2 + \omega_c^2 + \omega_l^2 \pm \tfrac{1}{2}\sqrt{(\omega_t^2 + \omega_c^2 + \omega_l^2)^2 - 4\omega_t^2\omega_l^2} \tag{13}$$

To each of these natural frequencies, hereafter denoted by $\omega_1$ and $\omega_2$ (corresponding to the minus sign and plus sign, respectively) there exist corresponding eigenmodes which are special linear combinations of the load and boom tip motions. Explicitly, the modes of the natural crane oscillations can be represented by the following normalized eigenvectors:

$$x_1 = \frac{1}{\sqrt{1 + (1 - \omega_1^2/\omega_l^2)^2}} \begin{bmatrix} 1 - \omega_1^2/\omega_l^2 \\ 1 \end{bmatrix} \tag{14}$$

-continued $$x_2 = \frac{1}{\sqrt{1 + (1 - \omega_2^2/\omega_l^2)^2}} \begin{bmatrix} \omega_2^2/\omega_l^2 - 1 \\ -1 \end{bmatrix} \tag{15}$$

It may be shown that $\omega_1 < \omega_l < \omega_2$, implying that the coefficients of the two modes have respective equal and opposite signs. In other words, the boom tip and the load oscillate in phase in the low frequency mode, while they oscillate with opposite phases in the high frequency mode. It is also worth noting that when the coupling is small, that is when $\omega_c^2 \ll \omega_t \omega_l$, then the two resonance frequencies approaches $\omega_1 \approx \omega_t$ and $w_2 \approx \omega_l$. It is therefore convenient to call the modes associated with $\omega_1$ and $\omega_2$ the boom mode and the load mode, respectively.

As will be explained in the following part of the description, the method according to the invention provides a reduction in the dynamic peak loads during load pick-up by the method involves a modified speed control so that the winch speed responds to variations in the load. This control also represents an energy absorbing effect that dampens resonance oscillations and dynamic peak loads. The result of such control is reduced dynamic loads, which means improved safety, improved operational weather window or a combination of the two.

BRIEF DESCRIPTION OF THE DRAWINGS

Below, an example of a preferred method and device is explained under reference to the enclosed drawings, where.

DETAILED DESCRIPTION OF THE PREFERRED EMBODIMENTS

Figure 1:
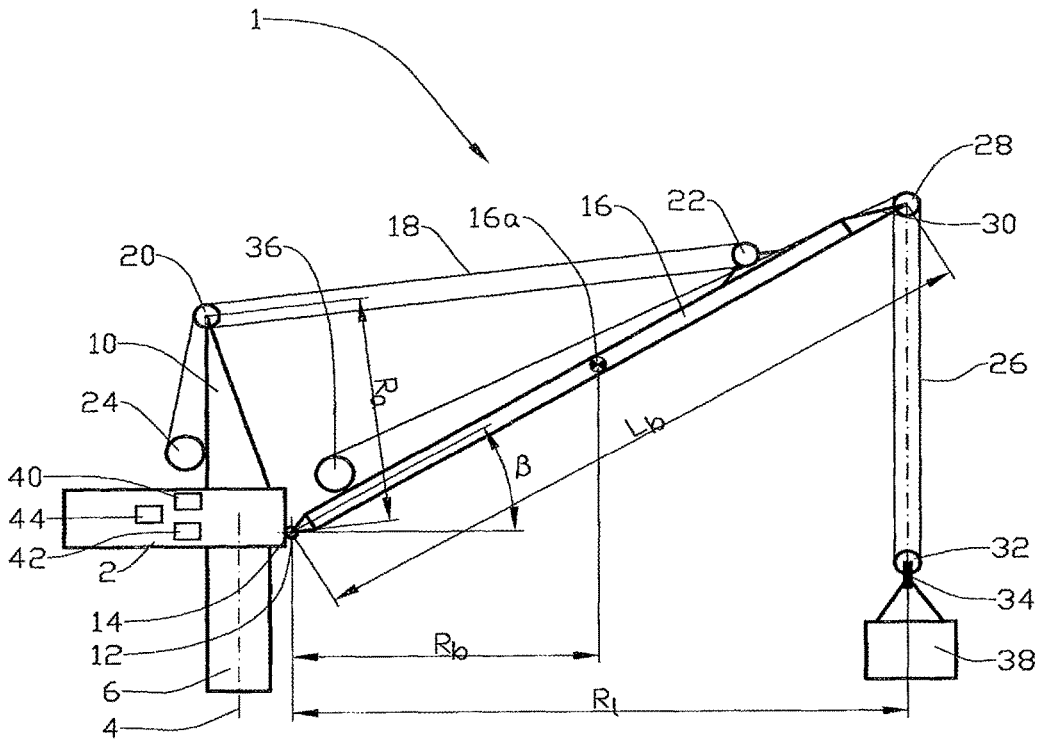
FIG. 1 shows schematic view of a crane that is equipped to perform the method according to the principles described herein.

In the present document an offshore crane is utilized for explaining the invention. This does not in any way limit the scope of the document as the principles disclosed here are applicable for similar cranes wherever they are used.

In the present document electrical driven winches are utilized for explaining the invention. This does not in any way limit the scope of the document as the principles disclosed here are applicable also for hydraulically driven winches.

It is to be emphasized that the present invention is focusing on vertical load and boom oscillations, not on the of pendulum oscillations of the load. The latter problem is solved by a number of different techniques, see EP 1886965, U.S. Pat. No. 5,823,369 or U.S. Pat. No. 7,289,875

On the drawings the reference number 1 denotes a pedestal crane that includes a slewing platform 2 that is turnable about a vertical axis 4 of a pedestal 6. The pedestal 6 is fixed to a structure not shown.

An A-frame 10 extends upwardly from the platform 2, while a hinge 12 having a horizontal axis 14 connects a boom 16 of the platform 2. The boom 16 has a centre of gravity 16*a*.

A boom rope 18 having a number of falls extends between a rope sheave 20 located at the top of the A-frame 10 and a rope sheave 22 on the boom 16. The boom rope (18) is connected to a boom winch 24 that is fixed to the A-frame 10. The boom winch 24 is controlling the luffing motion of the boom 16, thus regulating an angle β between the boom 16 and a horizontal plane.

A hoist rope 26 having a number of falls extends between a rope sheave 28 near the tip 30 of the boom 16 and a rope sheave 32 at a hook 34. The hoist rope (26) is connected to a hoist winch 36. The hoist winch 36 is located at the boom 16 and controls the lifting motion of the hook 34. A load 38 is connected to the hook 34.

The boom winch 24 and the hoist winch (36) are electrically connected to a boom speed controller 40 and a hoist speed controller 42. The speed controllers 40, 42 are of a type commonly used for cranes and well known to a skilled person and may be controlled by a Programmable Logic Controller (PLC) 44.

The speed controllers 40, 42 are often included in respective drives (not shown) having power electronics controlling motors (not shown) for the winches 24, 36.

The speed signal from the winches 24, 36 necessary for winch speed control can be analogue or digital tachometers attached to either a motor axis or a drum axis (not shown) of each winch 24, 36. The signal is routed to the respective speed controller 40, 42 being a normal part of the drive electronics. Optional tension sensors can be specially instrumented center bolts (not shown) of the sheaves 20, 22 and 28, or they can be strain gauges sensors (not shown) picking up the force moments in the A-frame 10 and in the boom tip 30. These tension signals are routed to a central computer or a PLC 44 for processing, to give the desired modification of the operator reference speed routed to the drive speed controllers 40, 42. It is also a possibility that the torque signals are routed directly to the drive, provided that the drive is digital with sufficient processing capacity to transform the force signals into a modified speed reference signal.

In FIG. 1 the load radius, that is the horizontal distance from the hinge axis 14 to the hook 34, is denoted $R_l$, the moment radius to the boom rope 20 from the hinge axis 14 is denoted $R_a$ while the boom weight radius that is the horizontal distance from the hinge axis 14 to the centre of gravity 16*a* of the boom 16 is denoted $R_b$.

Figure 2:
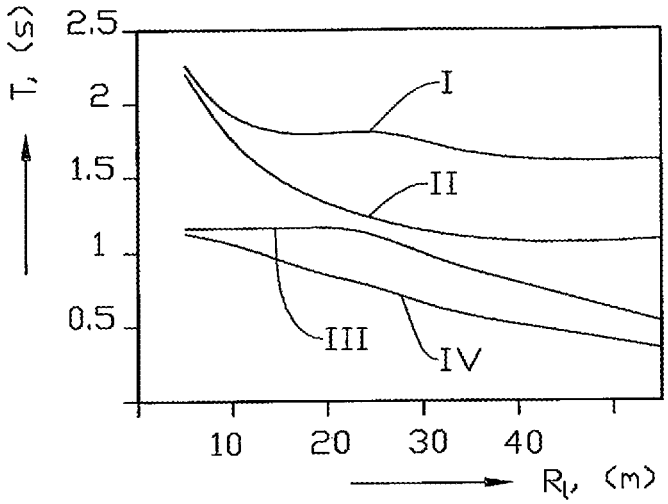
FIG. 2 shows a graph of natural oscillating periods of crane modes.

FIG. 2 shows how the natural periods (related to the angular frequency through $T=2\pi/\omega$) of a typical offshore crane vary with the load radius $R_l$. The calculations are carried out with a constant position of the load 38 at 25 m below the boom hinge 12 so that the hoist rope 26 length also vary with the boom angle β and load radius $R_l$. The load is taken from a load chart and represents the largest safe working load for sea lifts with a significant heave height of 2 m. Key crane and wire rope parameters are:

$M_l$=10 000 kg Load mass $L_b$=59.1 m Boom length $J_b$=41e6 kgm$^2$ Boom inertia d=32 mm Rope diameter (both winches)

E=60 GPa Effective modulus of rope elasticity $n_t$=8 Number of falls for the top winch $n_l$=3 Number of falls for the hoist winch In FIG. 2 the curve I shows the boom mode period $T_1=2\pi/\omega_l$, curve II shows the empty boom mode period $T_t=2\pi/\omega_t$, the curve III shows the load mode period $T_l=2\pi/\omega_l$ with fixed boom and the curve IV shows the load mode period $T_2=2\pi/\omega_2$.

The two modes, represented by their periods $T_1$ and $T_2$, have a higher separation than the uncoupled boom and load modes, represented by the periods $T_t$ and $T_l$, respectively. However, the coupling effect varies with load radius $R_l$. With a short load radius $R_l$, i.e. a highly erected boom 16, the coupling is small, implying that the boom 16 and the load 38 oscillate nearly independent of each other.

Figure 3:
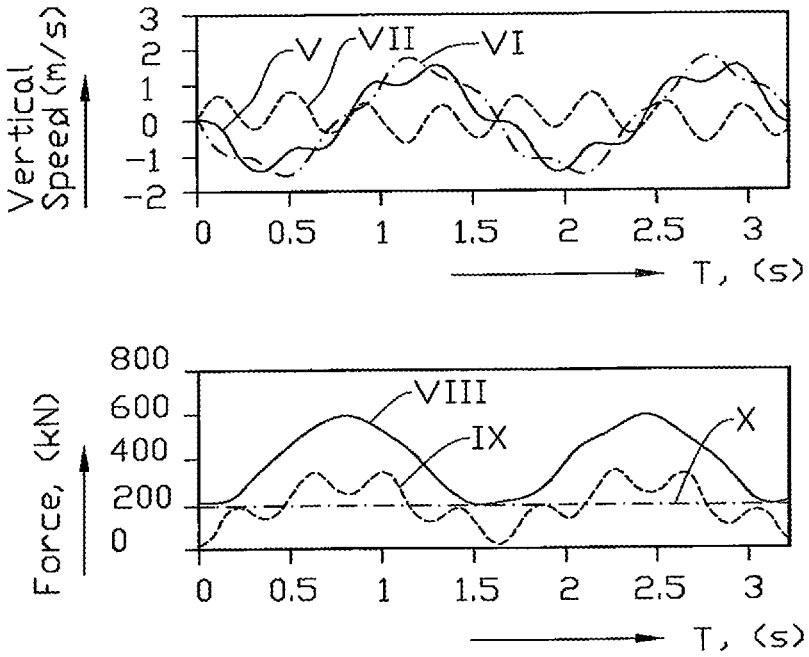
FIG. 3 shows in a graph a simulation of coupled crane and load oscillations.

FIG. 3 shows the simulated transient motion of a crane 1 for an idealized case when a support (not shown) of the load 38 is suddenly removed while the winches 24, 36 are locked. This case is calculated for the same crane 1 as above and with maximum permissible load at a radius of 43 m (boom angle of 38.6°).

In FIG. 3 the curve V shows the vertical speed of the boom tip 30, the curve VI shows the vertical speed of the load 38, while the curve VII shows the difference between the two. The curve VIII shows the effective top force, which equals the sum of tension forces of all falls in the boom rope 20 multiplied by the radius ratio $R_l/R_a$, the curve IX shows the sum of the tension forces in all falls of the hoist rope 26. The static weight (gravitation force) of the load 38 is included as curve X, for comparison.

The low frequency (boom) mode has a period of 1.6 s while the high frequency (load) mode has a period of approximately 0.4 s, in accordance with FIG. 2.

An embodiment of the invention includes damping by feedback induced winch motion.

It is assumed that the winches 24, 36 are not locked but may be perfectly controlled so that they are linear functions of the accelerations of the vertical boom tip 30 and load 38. It is convenient to write the winch motion as:

$$w=-S^{-1}\Phi^{-1}MDi\omega v \tag{16}$$

where D is a real damping (decay rate) matrix, to be determined. With this winch motion the equations of motion (10) becomes:

$$(-\omega^2 I+i\omega D+A)v=0 \tag{17}$$

This is a quadratic eigenvalue problem that can be solved to give complex eigenfrequencies and eigenvectors. The latter represent column vectors in the so-called eigenmatrix, often called $X=[x_1\ x_2]$ in text books of linear theory. This theory also predicts that the two modes can be independently damped if the damping matrix can be written as $D=X\Delta X^{-1}$ where Δ is a diagonal matrix representing the decay rates $\delta_1$ and $\delta_2$ for the two modes.

The boom tip 30 and load 38 accelerations are normally not measured directly. They can, however, be estimated from the tension forces, because the equation of motion may be written in the following form $Mi\omega v=\Phi f$. The winch motions required to achieve a controlled and independent damping of the two modes are therefore given by the vector $$w=S^{-1}\Phi^{-1}MX\Delta X^{-1}M^{-1}\Phi f \tag{18}$$

If the two decay parameters are equal so that $\Delta=\delta I$, then this expression simplifies greatly to $w=-\delta S^{-1}f$. More explicitly the optimal top winch 24 speed is $w_t=-\delta\cdot f_t/S_t$ while the optimal hoist winch 36 speed is $w_h=-\delta\cdot f_h/S_h$. Although these formulas describe complex Fourier amplitudes of speeds and forces, they also apply in the time domain. However, it is necessary to apply a kind of high pass or band pass filter in the feedback loop, in order to avoid load dependent slip of the winch speeds. The lower angular cut-off frequency should be well below the lowest crane resonance frequency, $\omega_1$, and the upper should be well above the highest one, $\omega_2$, to avoid serious phase distortion at the resonance frequencies. An alternative to using a common wide band pass filter is to apply individual filters for each winch. The top winch feedback signal should then have a filter that is centred around the lowest resonance frequency while the winch feedback signal should have a filter centred around the highest resonance frequency. A suitable filter could be a second order band pass filter represented by:

$$H_m = \frac{2i\omega\omega_m}{(\omega + i\omega_m)^2} \tag{19}$$

and where the subscript $_m$ denotes the mode number 1 or 2. It should be noticed that filtering introduce a weak coupling between the modes so that the resonance frequencies and the damping are slightly shifted from the uncoupled and non-filtered values.

Figure 4:
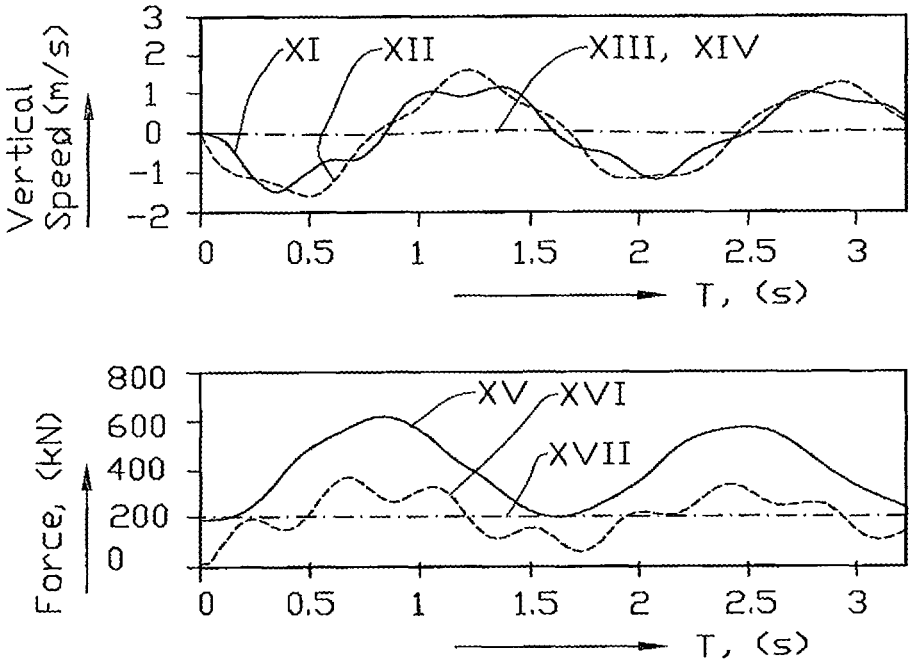
FIG. 4 shows in a graph a simulation of crane oscillations with unlocked and stiffly controlled winches.

In FIG. 4 that shows crane oscillations with unlocked and stiffly controlled winches, the curve XI shows vertical speed of the boom tip 30, the curve XII shows the vertical speed of the load 38, the curves XIII and XIV shows the vertical speed of the boom winch 24 and the hoist winch 36, but they are so close to zero that they are virtually indistinguishable with the chosen scale of the y-axis. The curve XV shows force in the boom rope 20, the curve XVI shows the force in the hoist rope 26 while the curve XVII shows the force from the load 38.

Figure 5:
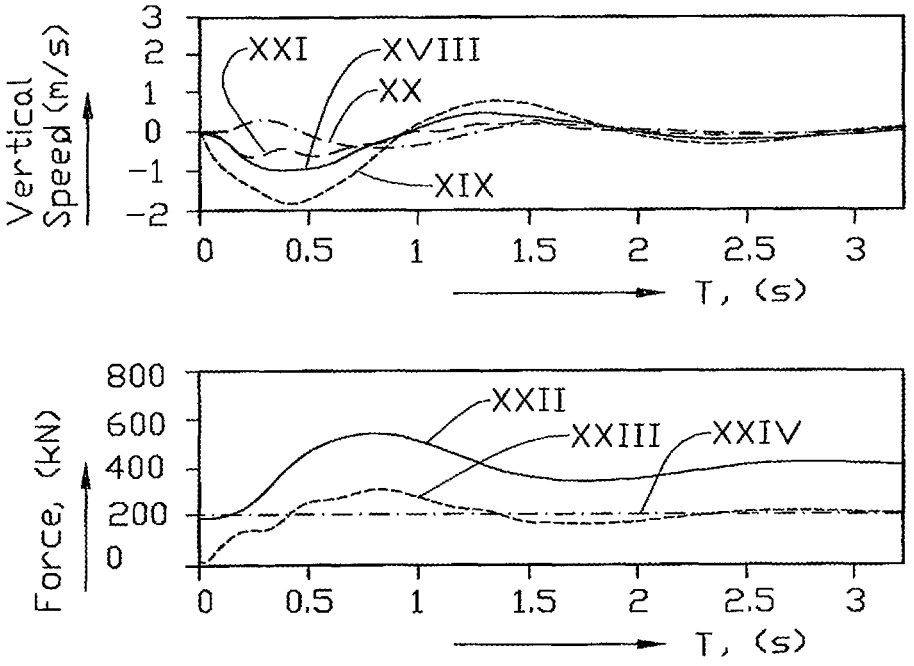
FIG. 5 shows in a graph a simulation of crane oscillations using force feed-back.

In FIG. 5 that shows simulated crane oscillations from a similar drop of the load, but now with force feedback induced damping motion of the two winches. The curve XVIII shows the vertical speed of the boom tip 30, the curve XIX shows the vertical speed of the load 38, the curve XX shows the speed of the boom winch 24, the curve XXI shows the speed of the hoist winch 36, the curve XXII shows force in the boom rope 20, the curve XXIII shows the force in the hoist rope 26 while the curve XXIV shows the force from the load 38.

As shown in the FIGS. 4 and 5, damping may be achieved by either acceleration or force feedback for modifying the winch speeds. This kind of winch control is called cascade regulation, because the feedback is an outer control loop using the existing speed controller. The speed controller should be rather stiff to give minimal speed error, which is the difference between demanded and actual speed.

An alternative embodiment of the invention includes damping by tuned winch speed control.

Damping may be achieved by tuning of the winch speed controllers 40, 42, without feedback from measured accelerations or forces. This is justified below.

Details of the derivation of the equation of motion for the winch motion is not explained, but it may be shown that the basic moment balance for the two winches can be transformed into the following matrix equation:

$$i\omega J_m\omega_m = Z_m(\omega_{set} - \omega_m) - Rf \tag{20}$$

where $J_m$ is a motor inertia matrix, $\omega_{set}$ is the vector of operator set motor speeds, $\omega_m$ is the vector of the actual angular motor speeds, $Z_m$ is a speed controller impedance matrix, and R is a coupling radius matrix. All matrices are diagonal where the upper left elements represent the top winch. The two elements of the coupling radius matrix are $R_{11}=R_tR_l/(n_gn_tR_a)$ and $R_{22}=R_h/(n_gn_l)$ where $R_t$ is drum radius of top winch, $R_h$ is drum radius of hoist winch and $n_g$ is the gear ratio (motor speed/drum speed, assumed to be equal for the two winches).

The above equation may be transformed to a corresponding equation for vertical winch motions by pre-multiplying $R^{-1}$ by and inserting the identity $R^{-1}R$ in front of the winch motion vectors:

$$i\omega M_w w = Z_w(w_{set} - w) - f \tag{21}$$

Here $M_w=R^{-2}J_m$ is effective winch mass matrix, $w=R\omega_m$ is the vertical winch speed vector and $Z_w=R^{-2}Z_m$ is the impedance matrix for vertical speed control. If the speed controllers are standard and independent PI controllers, then this matrix may be represented by $Z_w=P_w+I_w/i\omega$ where $P_w$ and $I_w$ are diagonal matrixes representing the proportional and integral terms, respectively. (The latter should not be confused with the identity matrix which has no subscript.) Using equation (8) for the rope force vector f and assuming constant operator set speed ($w_{set}=0$) the above equation may be rewritten as:

$$(-\omega^2 M_w + i\omega P_w + I_w + S)w = S_v v \tag{22}$$

Combining this matrix equation with equation (10) lead to:

$$\{(-\omega^2 M_w + i\omega P_w + I_w + S)(-\omega^2\Phi^{-1}M + S_v) - SS_v\}v = 0 \tag{23}$$

Here the fact is used that diagonal matrices commutate, that is, they may change order. This equation may alternatively be written as:

$$\{\omega^4 M_w\Phi^{-1}M - i\omega^3 P_w\Phi^{-1}M - \omega^2((I_w+S)\Phi^{-1}M + M_wS_v) + i\omega P_wS_v + I_wS_v\}v = 0 \tag{24}$$

This $4^{th}$ order matrix equation has 8 roots or complex eigenfrequencies that make the matrix within the curly brackets singular. These roots must be found numerically since no analytical solutions exist. It is also possible, by iterations, to solve the inverse problem, which is to find speed controller parameters (the four diagonal terms of $P_w$ and $I_w$) that represent specified damping rates. Numerical examples have shown that if the integral constant matrix is chosen to be:

$$I_w = \Omega^2 M_w \tag{25}$$

and the proportional matrix is:

$$P_w = \tfrac{1}{2}\Delta^{-1}M^{-1}S^2\Omega^{-2} \tag{26}$$

where $\Omega=\mathrm{diag}(\omega_1,\omega_2)$, then the two modes have approximately the same real frequencies as with locked winches and they are dampened with decay rates close to the specified diagonal terms $\Delta$. The above choice for $I_w$ can be regarded as a frequency tuning of the speed controllers, causing the top winch and hoist winch mobility to have maxima at $\omega_1$ and $\omega_2$, respectively. The above choice for $P_w$ can regarded as a softening of the speed controllers so that the winches respond to the load variations and absorb vibration energy more efficiently than stiff controllers do.

The winch inertia, represented by $M_w$ or $J_w$, strongly affect the absorption band width of the tuned speed controllers 40, 42. A high inertia makes the absorption band width narrow while a low inertia improves the band width is improved. A low inertia is favourable because it causes the winch to dampen crane oscillations effectively even if the real resonance frequency deviates substantially from the tuned frequency of the speed controller 40, 42.

The mechanical winch inertia $M_w$ is mainly controlled by the motor inertia, the drum inertia, the gear ratio and the number of falls. In practice, the possibility to select a low inertia is limited because a higher gear (or a lower number of falls) is in conflict with a high pull capacity.

However, the effective inertia can be reduced by applying an extra inertia compensating term in the speed controller. This new term is proportional to the measured motor acceleration and can be written as $i\omega J_c\omega_m$, where $J_c$ is a diagonal matrix, typically chosen as some fraction, typically 50%, of the mechanical inertia. If this torque term is added to the right hand side of equation (20), it is realized that it cancels part on the mechanical inertia term on the left hand side. An easy way to include such an inertia term is to redefine the effective motor inertia so that it represents the difference between the mechanical and the compensated inertia, that is $J_m=J_{mm}-J_c$ where $J_{mm}$ now represents the mechanical inertia of the winch motors. With this redefinition analysis above applies also when an inertia compensation term is included.

It is not recommended to compensate for the entire mechanical inertia, only up to a maximum of 75%, say. This is because the optimal I-term of the speed controller 40, 42 is proportional to the effective inertia, as shown explicitly in equation (25), and it is desirable to retain some integral action to avoid low frequency speed errors or slip speeds. A practical implementation of inertia compensation should also include some kind of low pass filter of the speed based acceleration signal. This is because time differentiation is a noise driving process that can give high noise levels if the speed signal is not perfectly smooth. The cut-off frequency of such a low pass filter must be well above the tuning frequency in order to avoid large phase distortion of the filtered acceleration signal.

A practical way to implement the desired damping by tuned speed control is to predetermine P- and I factors and store them in 2D look-up tables in the memory of the Programmable Logic Controller (PLC) used for controlling the winches. When a new combination of the pay load and the load radius is detected, the correct speed controller values are picked from these look-up tables for updating the speed controllers.

The dynamically tuneable speed controllers can either be implemented in the drives, that is, in the power electronics controlling the winch motors, or in the PLC controlling the drives. In the latter case the drives must be run in torque mode, which means that the speed controller is bypassed and the output torque is controlled directly by the PLC.

If the pick-up load is known a priori, that is before a lift starts, the resonance frequencies and the speed controller parameters should be adjusted according to this load. If the load is not known a priory, a load estimator should quickly find an approximation of the load based on measured rope tension forces. Alternatively, the load can be roughly estimated from the hoist winch torque, after correcting for friction and inertia effects.

Figure 6:
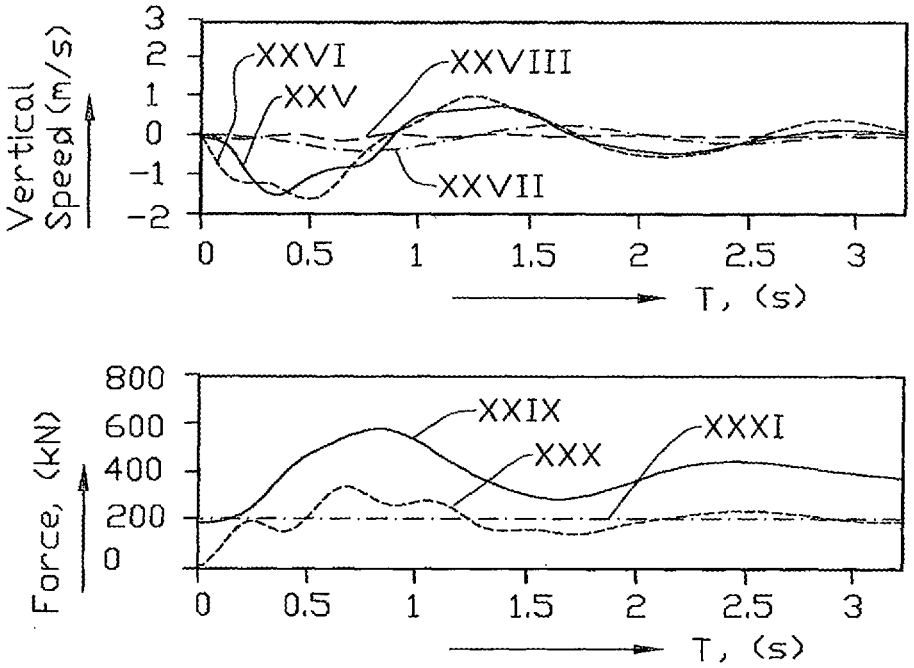
FIG. 6 shows in a graph a simulation of crane oscillations using tuned speed controllers.

Simulation results with tuned speed controllers are shown in FIG. 6. In FIG. 6 the curve XXV shows vertical speed of the boom tip 30, the curve XXVI shows the vertical speed of the load 38, the curve XXVII shows the speed of the boom winch 24, the curve XXVIII shows the speed of the hoist winch 36, the curve XXIX shows force in the boom rope 20, the curve XXX shows the force in the hoist rope 26 while the curve XXXI shows the force from the load 38.

Even though the condition of a suddenly removed load support is not very realistic, it illustrates the effect of damping of the transient crane oscillations. The damping for the two modes are not identical but quite similar to the feedback induced damping.

The above formalism, where the crane and winch dynamics are described by matrices and vectors, may be generalized and applied also to more complex crane structures with higher degrees of freedom. As an example, if the inertia of the pedestal and A-frame is not neglected, the crane dynamics with locked winches can be described by a similar matrix equation as equations (10) and (11) but now representing a 3×3 matrix equations. The new system matrix has three eigenfrequencies where the two lowest ones are close to the frequencies found above, and where the highest one represents the resonance frequency of the pedestal/A-frame system.

A similar expansion of the degrees of freedom is needed if the boom is treated as a flexible element rather than a completely fixed structure. In the case of complex crane structures modelled with three or more degrees of freedom the top winch and the hoist winch are no longer capable of damping all crane modes independently. Although active winch control will affect all crane modes, the most pronounced damping effect is expected on the modes for which the feedback or speed control is tuned.

What is claimed is:

1. A device for reducing resonant vibrations and dynamic loads of cranes, the device comprising:

a boom winch configured to control a luffing motion of a pivoting boom; and a hoist winch configured to control a vertical distance between a boom tip and a pay load of the crane;

a boom winch speed controller coupled to the boom winch; and a hoist winch speed controller coupled to the hoist winch;

wherein the device is configured to acquire resonance frequencies of a coupling of the pivoting boom and the pay load from at least inertia data of the pivoting boom and stiffness data on at least a boom rope coupled to the boom winch and a hoist rope coupled to the hoist winch, the resonance frequencies including a first resonance frequency and a second resonance frequency, the second resonance frequency being lower than the first resonance frequency;

wherein the boom winch speed controller or the hoist winch speed controller is configured to automatically modify a motion of the boom winch or a motion of the hoist winch, respectively, to induce a damping inducing winch motion;

wherein the boom winch speed controller comprises a proportional integral (PI)-type speed controller that is tuned to absorb vibration energy at the second resonance frequency; and wherein the hoist winch speed controller comprises a PI-type speed controller that is tuned to absorb vibration energy at the first resonance frequency.

2. The device of claim 1, wherein the boom winch speed controller includes an integral factor and a proportional factor, and wherein the hoist winch speed controller includes an integral factor and a proportional factor;

wherein the integral factor of the boom winch speed controller is substantially equal to a product of an effective inertia of the boom winch and a squared angular boom resonance frequency;

wherein the integral factor of the hoist winch speed controller is substantially equal to a product of an effective inertia of the hoist winch and the squared angular boom resonance frequency; and wherein the proportional factor of the boom winch and the proportional factor of the hoist winch each comprise linear combinations of an inverse of the resonance frequencies squared.

3. The device of claim 2, wherein the proportional factor of the boom winch speed controller is proportional to the square of an effective stiffness of a crane pedestal and the boom rope and inversely proportional to a boom inertia and a square of the angular boom resonance frequency squared; and wherein the proportional factor of the hoist winch speed controller is proportional to the square of an effective stiffness of the hoist rope and inversely proportional to an inertia of the pay load and a square of an angular load resonance frequency.

4. The device of claim 3, wherein at least one of the boom winch speed controller and the hoist winch speed controller includes an inertia-compensating term, wherein the inertia-compensating term comprises a product of a time derivative of a measured speed of the corresponding one of the boom winch or hoist winch, and a fraction of a mechanical winch inertia of the corresponding one of the boom winch or hoist winch.

5. A method for reducing resonant vibrations and dynamic loads of cranes, wherein a vertical motion of a pay load is controlled by a boom winch controlling a luffing motion of a pivoting boom and a hoist winch controlling a vertical distance between a boom tip and the pay load, the method comprising:

determining resonance frequencies of a coupling of the pivoting boom and the pay load from at least from inertia data of the pivoting boom and stiffness data on at least a boom rope coupled to the boom winch and a hoist rope coupled to the hoist winch, the resonance frequencies including a first resonance frequency and a second resonance frequency, the second resonance frequency being lower than the first resonance frequency; and automatically modifying a motion of the boom winch or a motion of the hoist winch to induce a damping inducing winch motion in the boom winch or hoist winch, respectively, by tuning a proportional integral (PI)-type boom winch speed controller coupled the boom winch or a PI-type hoist winch speed controller coupled to the hoist winch;

wherein the boom winch speed controller is tuned to absorb vibration energy at the second resonance frequency; and wherein the hoist winch speed controller is tuned to absorb vibration energy at the first resonance frequency.

6. The method of claim 5, wherein tuning the PI-type boom winch speed controller further comprises:

choosing an integral factor of the boom winch speed controller that is substantially equal to a product of an effective inertia of the boom winch and a squared angular boom resonance frequency; and choosing a proportional factor of the boom winch speed controller that comprises a linear combination of an inverse of the resonance frequencies squared.

7. The method of claim 6, wherein the proportional factor of the boom winch speed controller is proportional to a square of an effective stiffness of a crane pedestal and the boom rope and inversely proportional to a boom inertia and a square of the angular boom resonance frequency squared.

8. The method of claim 5, wherein tuning the PI-type hoist winch speed controller further comprises:

choosing an integral factor of the hoist winch speed controller that is substantially equal to a product of an effective inertia of the hoist winch and a squared angular boom resonance frequency; and choosing a proportional factor of the hoist winch speed controller to comprise a linear combination of an inverse of the resonance frequencies squared.

9. The method of claim 8, wherein the proportional factor of the hoist winch speed controller is proportional to the square of an effective stiffness of the hoist rope and inversely proportional to an inertia of the pay load and a square of an angular load resonance frequency.

* * * * *